United States Patent [19]

Doiron

[11] Patent Number: 4,750,395

[45] Date of Patent: Jun. 14, 1988

[54] SAFETY CHAIN FOR CHAIN SAWS

[76] Inventor: Gerald J. Doiron, 40 Franklin St., Athol, Mass. 01331

[21] Appl. No.: 9,879

[22] Filed: Feb. 2, 1987

[51] Int. Cl.[4] ..... B27B 33/14

[52] U.S. Cl. ..... 83/834; 83/830; 83/DIG. 1

[58] Field of Search ..... 83/830, 831, 834, DIG. 1; 30/382

[56] References Cited

U.S. PATENT DOCUMENTS

| | | | |
|---|---|---|---|
| 4,430,795 | 2/1984 | Wetzel et al. | 83/831 |
| 4,590,836 | 5/1986 | Doiron | 83/834 |
| 4,604,932 | 8/1986 | Doiron | 83/830 |
| 4,608,901 | 9/1986 | Doiron | 83/834 |
| 4,643,065 | 2/1987 | MacGavin | 83/830 |

FOREIGN PATENT DOCUMENTS

| | | | |
|---|---|---|---|
| 619823 | 5/1961 | Canada | 83/834 |
| 3145672 | 9/1982 | Fed. Rep. of Germany | 83/834 |

*Primary Examiner*—Frank T. Yost
*Assistant Examiner*—Hien H. Phan
*Attorney, Agent, or Firm*—Charles R. Fay

[57] ABSTRACT

A safety chain for a chain saw comprising drivers connected by side link units each having a pivot fulcrum on its lower edge running in contact with the saw blade kerf bottom, the side links including a cutter tooth, a depth gauge, and a safety device for the particular cutter.

5 Claims, 2 Drawing Sheets

FIG. 8
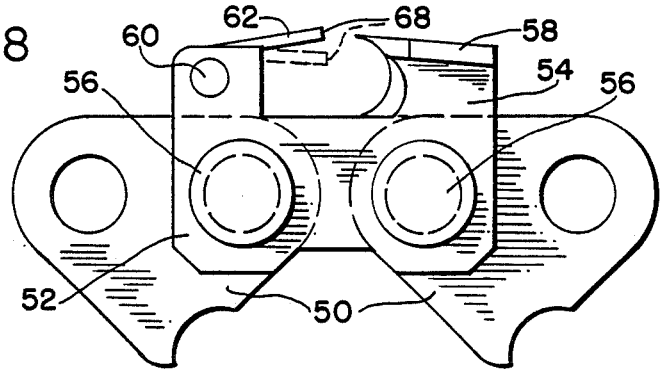
FIG. 9
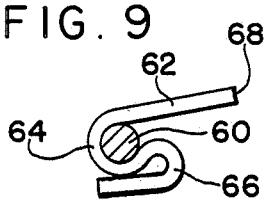
FIG. 10
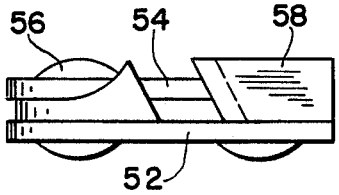
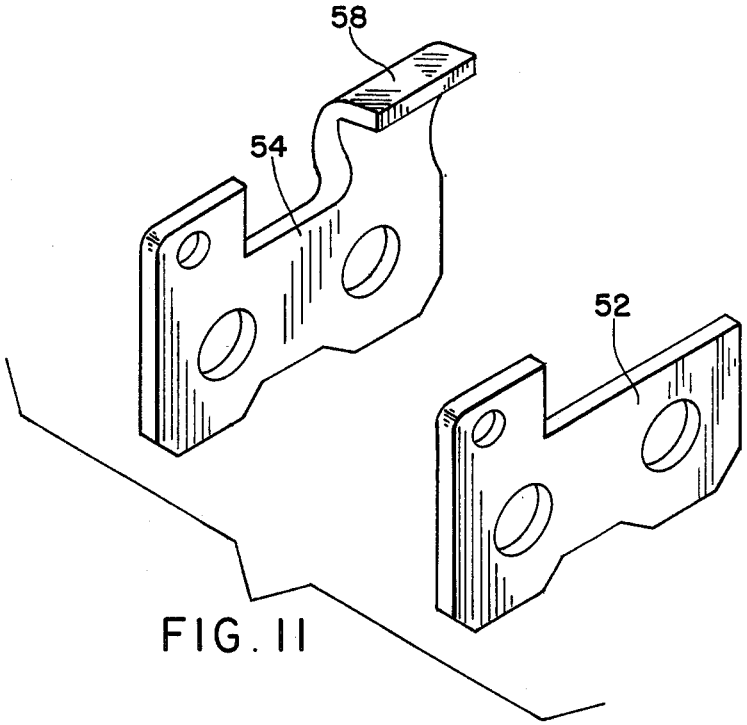
FIG. 11

SAFETY CHAIN FOR CHAIN SAWS

BACKGROUND OF THE INVENTION

Reference is made to U.S. Pat. No. 4,608,901, Sept. 2, 1986 wherein the cutting teeth are inhibited from cutting soft materials, e.g. flesh, will cut wood, a harder material. The object of the present invention is similar but is directed to a structure of wider application, the prior art having limitations as to length of cut, and in some cases, speed.

SUMMARY OF THE DISCLOSURE

In this case, the guard link and the guard element, as well as the cutter and cutter link, but appear on side links, between drivers. Normally, and also when applied to soft material, the guard link is in a position to prevent engagement of cutter therewith, but as the chain passes onto a wood surface, the guard link deflects away from the wood due to contact with the harder surface, thereby momentarily clearing it for cutting by the ensuing cutting tooth. At this point, the cutting link is rocked back to a limited degree, as is also a depth of cut gage and its link. The overall result is that the projection of the cutting tooth into the wood, and thus the depth of cut, is limited. However, there is of course tension on the chain, and this tension ensures that the guard link resumes its original position and the cutting tooth extends slightly beyond it to its cutting position, regardless of the length of cut.

BRIEF DESCRIPTION OF THE DRAWINGS

FIG. 8 is a side elevational view of an alternative construction utilizing a spring as a guard;

FIG. 9 is a detail of the guard spring;

FIG. 10 is a top plan view of FIG. 8; and

FIG. 11 is a perspective view of the side links.

PREFERRED EMBODIMENT OF THE INVENTION

Figure 1:
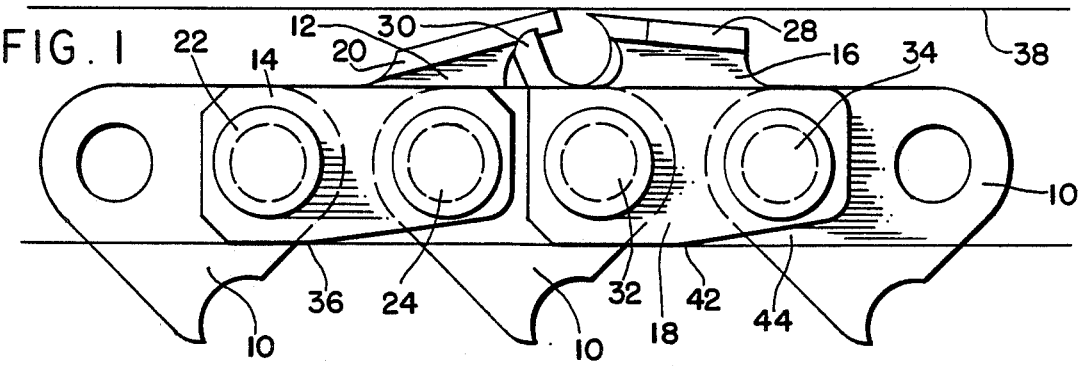
FIG. 1 is a side elevational view of a section of the new chain in safety position, i.e., both idle and soft material position.
Figure 2:
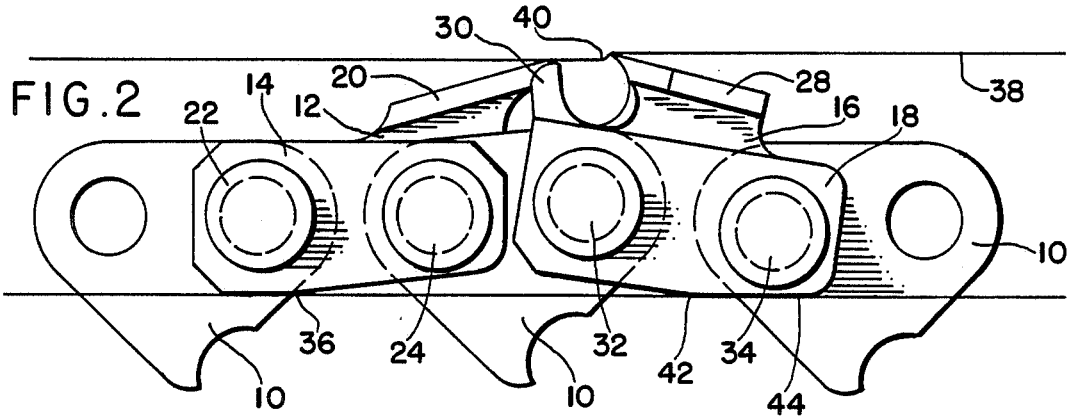
FIG. 2 is a similar view but showing the chain section in cutting position.
Figure 3:
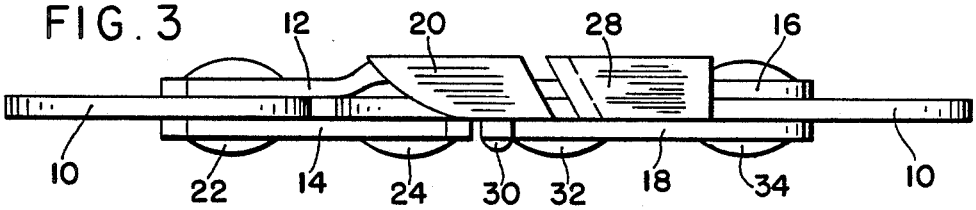
FIG. 3 is a top plan view.
Figure 4:
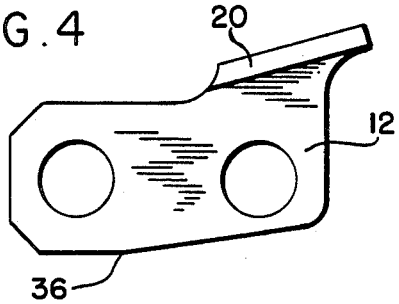
FIG. 4 is a side elevational view of a guard side link.
Figure 5:
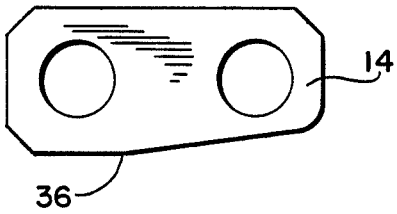
FIG. 5 is a similar view of a side link.
Figure 6:
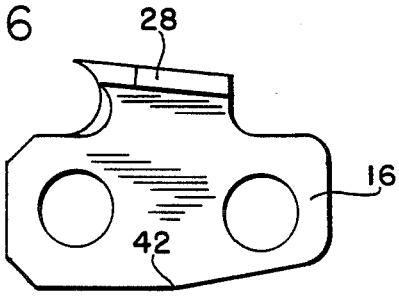
FIG. 6 is a similar view of a cutter side link.
Figure 7:
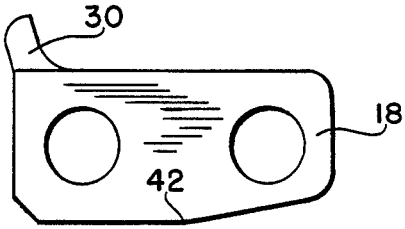
FIG. 7 is a similar view of a depth gage side link.

In FIGS. 1, 2, and 3 the driver links 10 are all more or less the same and are connected by side links 12, 14, as a pair, and side links 16, 18 as a pair. Side links 12, 14 are the guard links, link 12 having the guard 20 on it, this guard being rigid and pointing rearwardly. These links 12, 14 are a pair being connected by the usual headed pivots at 22, 24, to the driver links, as will be clear to those familiar with this art. Side links 16 and 18 are respectively the cutter link and the depth gage link. The cutter link 16 has cutter 28 on it and side link 18 has the gage 30 on it. This gage 30 is bent slightly out of line with the main body of link 18 to avoid interference withe the guard 20, see FIG. 3. Both cutter 28 and guard 30 are formed to extend laterally of their links into cooperative widths, again see FIG. 3. Side links 16, 18 are connected by pivots 32, 34, to each other as a pair, in the manner of links 22, 24, and also to driver links 10.

All side links 12, 14, 16, and 18 are provided with "rocker", or angled, bottom edges that ride on the bottom of the channel of the blade the chain rides on. This is clearly shown in FIGS. 1, 2, and 4–7, and these configurations are the same for side link pair 12, 14, and also for side link pair 16 and 18.

In the operation of this chain, application of the traveling links to soft material such as flesh will not provide a cut, because the guard 20 remains in FIG. 1 condition, so that only the guard engages the material. But when the same chain is applied to wood, the gage 20 will momentarily deflect down on point 36 as a pivot, in the FIGS. 1 and 2 thereby clearing the surface 38 for cutting at 40. When this occurs, the cutting resistance causes side links 16, 18 to rock back, pivoting on points 42 and closing the previously open gap at 44, as will be seen by a comparison of FIGS. 1 and 2. This projects the gage 30 to the FIG. 2 position where it bears on the bottom of the saw kerf and prevents over extension of the cutter into the wood. With the cutter 28 engaging the wood, the chain tension is increased and this tension causes the cutting teeth to maintain cutting contact with the wood.

The momentary depression of side links 12, 14, act on drive link 10 to tend to urge it anti-clockwise enough to elevate links 16, 18, through pivot 32, to achieve the clockwise motion required to bring cutter 28 and gage 30 up to operative position.

An alternative structure is shown in FIGS. 8–10 inclusive. Drivers 50 are connected to side links 52, 52, by pivots 56. The side links are spaced by the drivers and link 52 is L-shaped, while link 54 is generally U-shaped. One leg of the latter has the cutter 58 thereon and the other leg matches the leg on L-shaped link 52. A pivot 60 connects these legs, FIG. 8.

A flat spring having the shape shown in FIG. 9 snaps onto pivot 60 between the legs and it includes guard portion 62, snap part 64, and tail 66, the latter being reversed on bearing on the edge of the driver. The degree of spring of the spring is controlled by its thickness. Soft material will not deflect the spring enough to allow cutting, but wood, engaging the free end 68 of the spring will deflect it enough to allow the cutting operation. If desired, a suitable stop could be provided to prevent too great a deflection of the spring.

I claim:

1. A chain saw chain comprising articualted drivers and side links in units, each unit including a cutter tooth on a side link, a safety guard for the cutter tooth on another side link, and a depth of cut gage on a third side link, a fourth link being plain, said side links having corresponding edges with central pivot points thereon which engage and slide on the usual bottom of the usual kerf in a conventional chain saw blade the side links being rockable on said bottom, the depth of cut gage link and the cutter tooth link being secured as a sub-unit, both sub-units being pivoted to a pair of adjacent drivers with the guard normally projecting slightly in the line beyond the cutter tooth and preventing cutting by the cutter tooth unless and until the saw is applied to cut a material having a hardness in the range of wood, whereupon the sub-unit of safety guard and plain link is rocked on its edge pivot causing an associated driver to dip at one end and thus raise the other end, the latter being pivoted to the cutter tooth sub-unit and raising the cutter tooth to cut the material to which the saw is applied by projecting beyond the safety guard.

2. The chain of claim 1 wherein the structure allows the safety guard sub-unit to tend to reposition in safety position, but engaging the material to be cut so as not to prevent cutting.

3. The chain of claim 1 wherein the sub-unit including the cutter and depth gage places the chain in cutting position by rocking on its pivot, and while the cutter tooth cuts, the gage prevents too deep a cut, the cutter tooth and gage being in fixed relation.

4. A chain for a chain saw having the usual cutter bar or blade having a kerf for the chain to run in and a bottom for the kerf, articulated drivers and interposed sub-units of side links pivoted to and between drivers, the sub-units being arranged in line to form the chain, one side link of one sub-unit including a cutting tooth and one side link of the next sub-unit including a safety guard in a position to prevent the cutter tooth from cutting, the other side link of the cutter tooth sub-unit including a depth gage the cutter tooth and depth gage being in fixed relation, the side links having bottom edges running on the saw bar kerf bottom and having angular configurations providing a central pivot fulcrum point on each side link so that each sub-unit is rockable fore and aft in the direction of the chain motion on the saw bar kerf bottom, the engagement of the safety guard with material of the hardness of wood causing the safety guard sub-unit to rock back, lowering the safety guard momentarily, in turn causing the adjacent driver to rock up, in turn causing the cutter tooth sub-unit to rock up and project the cutter tooth to a degree to cause it to cut, the driver and the two sub-units forming a single cuttin unit.

5. The chain of claim 4 wherein the depth gage is located on the cutter tooth sub-unit in position to engage the work just prior to the cut, thereby limiting the degree of engagement of the cutter tooth with the work.

* * * * *